US006886574B2

(12) United States Patent
Budry, Jr. et al.

(10) Patent No.: US 6,886,574 B2
(45) Date of Patent: May 3, 2005

(54) SHEET METAL WASHER INCLUDING TANK ASSEMBLY AND WASHER CASSETTE MOUNTED ON THE TANK ASSEMBLY

(75) Inventors: William Robert Budry, Jr., Holly, MI (US); Mohamad A. Sebai, Dearborn, MI (US); Douglas J. Goetz, Warren, MI (US); David Berghorn, Waterford, MI (US); Michael J. Bleau, Grand Blanc, MI (US)

(73) Assignee: Utica Enterprises, Inc., Shelby Township, Macomb County, MI (US)

( * ) Notice: Subject to any disclaimer, the term of this patent is extended or adjusted under 35 U.S.C. 154(b) by 0 days.

(21) Appl. No.: 10/744,559

(22) Filed: Dec. 23, 2003

(65) Prior Publication Data

US 2004/0134524 A1 Jul. 15, 2004

Related U.S. Application Data

(62) Division of application No. 09/514,834, filed on Feb. 28, 2000, now Pat. No. 6,701,945.

(51) Int. Cl.[7] ..... B08B 3/02

(52) U.S. Cl. ..... 134/64 R; 64/122 R; 100/74

(58) Field of Search ..... 134/64 R, 64 P, 134/122 R, 122 P; 100/74; 396/612, 613, 614, 615, 616, 617, 618, 619, 620, 621, 622, 623, 624

(56) References Cited

U.S. PATENT DOCUMENTS 1,587,051 A * 6/1926 Thompson ..... 396/620
2,724,254 A * 11/1955 Zanger ..... 68/22 R
2,824,321 A 2/1958 Bandy
3,087,405 A * 4/1963 Sachs et al. ..... 396/578
3,202,526 A * 8/1965 Ostensen ..... 430/118
3,375,770 A * 4/1968 Hellyer ..... 396/614

(Continued)

FOREIGN PATENT DOCUMENTS

JP 4-174842 6/1992
JP 6-167797 6/1994

*Primary Examiner*—Frankie L. Stinson
(74) *Attorney, Agent, or Firm*—Brooks Kushman P.C.

(57) ABSTRACT

A sheet metal washer system for cleaning metal blanks includes a washer cassette with an open bottom that is selectively mounted on a tank assembly, a drive motor assembly and a filter assembly. The washer cassette includes an inlet opening and an exit opening with upper and lower entry rollers having a first predetermined durometer positioned adjacent to the inlet opening and upper and lower exit rollers having a second predetermined durometer positioned adjacent the exit opening. Upper and lower manifolds for delivering cleaning fluid from the filter assembly to the interior of the washer cassette are positioned between the entry and exit rollers. The sheet metal blank is cleaned by the entry rollers and dried by the exit rollers, as it passes through the sheet metal washer. The washer cassette preferably includes a safety mechanism for locking the upper entry and exit rollers into a storage position when the washer system is not in use. The washer cassette preferably further includes at least one quick disconnect air and fluid connection plate to permit one-step removal of all air and fluid lines from the washer cartridge. An optional exit spray system for coating the sheet metal blanks after being cleaned may be integrated within the washer cassette.

5 Claims, 7 Drawing Sheets

U.S. PATENT DOCUMENTS 3,435,749 A * 4/1969 Bouwel et al. ..... 134/122 R
3,636,662 A 1/1972 Maca
3,643,277 A 2/1972 Durst
3,701,526 A * 10/1972 Hope et al. ..... 271/272
3,747,499 A * 7/1973 Foster ..... 396/576
3,779,367 A 12/1973 Hope et al.
3,812,870 A 5/1974 Geyken et al.
3,852,789 A * 12/1974 Russell et al. ..... 396/618
3,860,944 A * 1/1975 Huber et al. ..... 396/622
3,922,702 A * 11/1975 Gaskell ..... 396/614
3,938,213 A 2/1976 DiFede
3,943,539 A * 3/1976 Bown et al. ..... 396/614
3,986,924 A 10/1976 Motoda
4,086,607 A * 4/1978 Muller ..... 396/572
4,091,404 A 5/1978 Schornig et al.
4,114,999 A 9/1978 Kogiso et al.
4,119,991 A * 10/1978 Martino ..... 396/614
4,128,326 A 12/1978 Selak
4,142,194 A 2/1979 Hamlin
4,148,576 A * 4/1979 Martino ..... 396/614
4,179,208 A 12/1979 Martino
4,252,429 A * 2/1981 Hope et al. ..... 396/622
4,301,728 A 11/1981 Jaffe et al.
4,353,635 A * 10/1982 Tanaka ..... 396/617
4,423,947 A * 1/1984 Jelinek et al. ..... 396/619
4,485,528 A 12/1984 Anahara et al.
4,536,909 A 8/1985 Burger et al.
4,544,253 A * 10/1985 Kummerl ..... 396/620
4,730,360 A 3/1988 Brugelmann
4,736,221 A 4/1988 Shidara
4,926,520 A 5/1990 Watson
5,036,689 A 8/1991 Sekiya et al.
5,134,937 A 8/1992 Derivi et al.
5,188,135 A 2/1993 Neumann et al.
5,213,042 A 5/1993 Larios
5,311,235 A * 5/1994 Piccinino et al. ..... 396/618
5,357,307 A 10/1994 Glanville et al.
5,396,309 A * 3/1995 Morita et al. ..... 396/614
5,516,220 A * 5/1996 Ishikawa et al. ..... 400/616.1
5,542,525 A 8/1996 Kornely
5,561,027 A 10/1996 Verlinden et al.
5,579,076 A 11/1996 Calisto et al.
5,689,754 A 11/1997 Yoshida et al.
5,723,266 A 3/1998 Morimoto
5,790,237 A 8/1998 Nomura et al.
5,862,820 A 1/1999 Kageyama et al.
5,903,954 A 5/1999 Gajewski
6,071,022 A * 6/2000 Verhoest et al. ..... 396/617

* cited by examiner 14
150
138
148
30
62
142
144
145
61
140
132
134a
134b
32
136a
136b
145
144
146
148
16

SHEET METAL WASHER INCLUDING TANK ASSEMBLY AND WASHER CASSETTE MOUNTED ON THE TANK ASSEMBLY

A divisional or application under 37 C.F.R. § 1.53(b) of prior application Ser. No. 09/514,834 filed on Feb. 28, 2000 now U.S. Pat. No. 6,701,945, entitled A SHEET METAL BLANK WASHER SYSTEM

TECHNICAL FIELD

This invention relates generally to industrial washers for cleaning sheet metal blanks. More particularly, the invention relates to a sheet metal blank washer system having a cleaning cassette that is selectively mounted on a tank, wherein the cassette has a plurality of rollers that cooperate with a spray system to clean sheet metal blanks.

BACKGROUND OF THE INVENTION

Known washers include a roller system and an integral tank that is fixedly secured below the roller system. The roller system utilizes six rollers, three lower rollers and three upper rollers that are positioned directly on top of the lower rollers, thereby forming three pairs of rollers. The first pair of rollers are the entry rollers, the second pair of rollers are the wash rollers, and the final pair of rollers are the exit rollers. A pre-defined gap exists between each pair of rollers to permit passage of the blank. The wash and exit rollers have substantially the same diameter, while the entry rollers have a diameter that is smaller than the wash and exit rollers. The washer has an inlet opening on one side and an exit opening on the opposite side. The upper and lower entry rollers are positioned adjacent the inlet opening and receive the metal blank to be cleaned and guide the blank into the washer. The center rollers are the wash rollers and are used to scrub the blank as it passes through the entry rollers. The exit rollers are positioned adjacent the exit opening and typically next to the washer rollers. A delivery system may be used to coat the metal blanks with lubricity film. A separate spray system is positioned between the entry rollers and exit rollers. The spray system includes a plurality of spray nozzles that inject a wash solution, often with a lubricity coating therein, onto the metal blank to assist in cleaning the blank. In one known washer, an air cylinder is operatively connected to the exit rollers to exert a predetermined pressure in pounds per linear inch (PLI), upon the metal blank as it is passed through the rolls to leave a predetermined amount of coating on the metal blank. In another known system, the wash rollers and exit rollers are supported by a back-up roller system that includes short steel rollers to exert a predetermined pressure on the metal blank to coat the blank. Both the lower and upper rollers are motor driven and are operatively connected to a motor by means of a complex chain drive.

However, known six roller washers have been found to be undesirable for a number of reasons. First, previous known washers have been relatively large, are quite heavy and therefore are not provided with a transport means to enable movement of the washer system to different locations within a manufacturing plant. In addition, the washer systems have been found to produce an inconsistent and uneven film coating thickness on the sheet metal blanks, thereby reducing the cleaning effectiveness of the washer. The chain driven rollers have also been found to be excessively noisy and difficult to disassemble in the event of washer failures or when routine maintenance is required. Moreover, the complexity of known roller systems require constant maintenance. For example, the rollers are not readily accessible when redressing is desired. Instead, to access the rollers, the entire washer much be disassembled. Such activity results in excessive manufacturing down time and loss revenue. Requiring washer disassembly even for routine maintenance may also result in unwanted component movement and even component loss or damage.

Accordingly, there is a need for a washer system that has fewer components, provides improved cleaning, allows for quick disassembly and accessibility to the internal components of the washer for routine maintenance and provides protection against undesirable component movement, loss, or damage

SUMMARY OF THE INVENTION

In accordance with the present invention, there is provided an improved sheet metal washer system having a selectively removable washer cassette member, entry and exit rollers, an integral cleaning spray system for delivering cleaning fluid to metal blanks passing through the washer cassette, and a contaminated fluid storage tank. An optional integral spray system for delivering film coatings may also be provided. The cassette member includes a number of machine components that are fixedly secured together to make up a cassette frame member. The frame member is covered with a metallic skin, preferably constructed of stainless steel for durability. The skin further includes hinged access doors positioned on both sides of the washer. Preferably, each side of the washer includes an upper hinge door that swings upwardly and a lower hinge door that swings downwardly. The hinged access doors advantageously provide access to the interior of the washer unit for routine maintenance or repair in the event of washer failures. The top surface of the washer is also provided with a hinged access door that lifts upward to permit easy access to the interior of the washer. See-through end plates are preferably removably connected to either end of the washer to permit easy monitoring of the mechanisms used to operate the washer and the bearing ends of the entry and exit rollers. The cassette further has an open bottom that cooperates with an open tank top when the cassette member is positioned on top of the tank to collect the contaminated fluid and debris being cleaned off of the metal blanks.

The tank preferably includes upwardly projecting locating pins that are received within locating apertures formed on a bottom surface of the cassette to insure proper positioning of the cassette onto the tank. The tank further includes a filter system that segregates the collected debris from the contaminated fluid such that the cleaning fluid may be recirculated into the cleaning spray system via intake manifolds that extend through one side of the cassette housing, to be explained below in further detail. It is preferred that the tank be provided with wheels to permit allow for easy maneuverability of the washer system.

The cassette is selectively removable from the tank and may be substituted with an identical cassette to allow for off-line periodic maintenance or failure, while reducing washer system downtime. Accordingly, the top of the washer cassette is provided with heavy-duty eyebolts that are connectable to lifting chains to permit selective lift-off of the washer by a crane or other suitable lifting mechanism.

In accordance with one aspect of the invention, the cassette has an inlet opening for receiving the metal blank and an outlet opening for ejecting the metal blank after it has been cleaned. The upper and lower hinged doors define the inlet and outlet openings, respectively. Provided within the cassette are four cleaning rollers, each of the rollers having substantially larger diameters than known washers such that the rollers do not require back-up support rollers. By reducing the cleaning rollers from six to four while simultaneously maintaining and often increasing blank cleanliness, as discussed below, a significant reduction in the number of washer system components on the order of fifty percent (50%) is achieved. The reduction in the number of washer components advantageously lowers both production and maintenance costs, as well as washer complexity.

The four cleaning rollers include two lower rollers and two upper rollers, with the upper rollers being positioned directly over the lower rollers. One pair of upper and lower rollers are positioned adjacent to the inlet opening and define the entry rollers that initially receive the metal blank to be cleaned. The second pair of upper and lower rollers define the exit rollers and are positioned adjacent to the outlet opening.

In accordance with an aspect of the invention, the entry rollers are operatively connected to first air cylinders to provide a first predetermined pressure in pounds per linear inch (PLI) to the blank to properly clean the metal blank by delivering cleaning fluid under high pressure. Preferably, the PLI exerted by the entry rollers is approximately 100 PLI. The entry rollers are fiber coated and have a first predetermined durometer (preferably less than 80 durometer) to give the roller a spongy consistency to agitate dirt and debris from the metal blank. Independently of the advantage provided by agitating dirt and debris for easier removal by the cleaning spray system, in practice it has been found that approximately 20% of the mill oil is directly removed by the entry rollers as the blank passes between them. The exit rollers are connected to second air cylinders to exert a second predetermined pressure PLI to the blank to properly remove the cleaning fluid and dry the metal blank. Preferably, the PLI exerted by the exit rollers is approximately 100–175 PLI. The exit rollers are fiber coated and have a second predetermined durometer that is greater than the first predetermined durometer of the entry rollers to dry the metal blank by a squeegee action as it passes between exit rollers. By providing air cylinders for both the entry and exit rollers, the PLI of the rollers is increased over prior art designs, enabling both water and oil based cleaning agents to be employed. Oil based cleaners require a higher PLI than water based cleaning agents. Positioned adjacent to the inlet and exit openings are a plurality of small guide rollers that guide the metal blank between the upper and lower rollers. Preferably, the guide rollers are positioned on a support bar that is secured to the lower hinge door on the entry and exit sides of the washer. Alternatively, the guide rollers may be positioned on a support bar that is connected to an end of the cassette frame.

The rollers are connected to bearing housings on each end of the washer cassette. A drive end of the washer cassette is positioned adjacent to a drive motor and an idle end is positioned adjacent a filter system. The distal ends of the rollers that are connected to the drive end of the washer cassette are connected to the bearing housings by means of non-expandable bearings. The distal ends of the rollers that are connected to the idle end of the washer cassette are connected to the bearing housings by means of expandable bearings that allow for a small degree of expansion of the rollers due to the heat generated by the washer system components.

The lower entry and exit rollers are each provided with an extended shaft on a drive end of the rollers that has a key member for connecting to a shaft drive bearing. A motor drive is positioned on the drive end of the washer, below the cassette unit on a support platform that is preferably integral with the tank. The motor drive includes an outwardly extending input shaft that is connected to a motor drive bearing. A selectively removable timing belt is connected to the motor drive bearing and shaft drive bearings to drive the lower entry and exit rollers. The upper entry and exit rollers, when in an operating position, are positioned in contact with one another such that the upper entry and exit rollers are friction driven by the lower rollers, thereby reducing drive components and simplifying the drive mechanism. An extremely tight fit for metal blank passage is also provided, thereby helping to maximize blank cleanliness. It is the spongy or selectively deformable nature of the rollers that permits the metal blank to pass between them since the outer surfaces of each roller is in contact with its mating roller. Once a blank passes, each roller returns to its non-deformed shape.

Further, disassembly of the drive mechanism is quickly and easily achieved by removing the timing belt. It is preferred that the drive end of the washer includes a recessed area in which the shaft drive bearings are located. The input shaft extends into the recessed area and has the drive shaft bearing positioned thereon. The removable see-through end plate is provided with an aperture for receiving the input shaft and the end plate is positioned over the recessed area to protect the drive mechanism from damage while permitting visibility of the drive assembly to monitor its operation.

In accordance with a further aspect of the invention, there is provided a safety lock on both ends of the washer. The safety lock is a pivoting spring loaded, pneumatically controlled member. The safety lock has an inverted T-shape and includes a pivoting end that is provided with apertures for receiving a pivoting shaft. Support arms are positioned opposite the pivoting end. The pivoting shaft is connected to an input arm that is operatively connected to an air cylinder. When the washer is shut off, the safety lock is automatically pivoted outwardly and the upper rollers are raised by air cylinders away from the lower rollers. Next, the safety lock is pivoted inwardly between the upper and lower rollers and locked into position, such that the support arms support stub ends of the upper rollers. When engaged, the safety lock advantageously provides clearance between the upper and lower rollers to permit safe and easy access to clean or maintain the interior of the washer. The safety lock is also utilized when transporting the cassette to insure that the rollers do not rub against one another during transport causing surface cuts or scratches, thereby prolonging wear life of the rollers.

The cassette further preferably includes an integral cleaning spray system. The cleaning spray system includes upper and lower manifolds that are fluidly connected to the filter system to introduce cleaning fluid to the metal blank. The upper manifold is positioned between the upper rollers and includes a plurality of fluid nozzles being downwardly directed at an angle at the nip (the roller contact portion on the metal blank) of the upper rollers. Preferably, each of the nozzles are equally spaced on either side of the manifold to provide uniform distribution of the cleaning fluid. Extending downwardly from the upper manifold are a plurality of small rollers that are used to guide the metal blank from the entry rollers to the exit rollers. Similarly, the lower manifold is positioned between the lower rollers and includes a plurality of fluid nozzles being upwardly directed at an angle at the nip of the lower rollers. Preferably, each of the nozzles are equally spaced on either side of the lower manifold to provide uniform distribution of the cleaning fluid. The nozzles preferably spray the metal blank at a predetermined rate of fluid per linear inch on both the upper and lower rollers. Extending upwardly from the lower manifold are a plurality of small rollers that cooperate with the rollers of the upper manifold to guide the metal blank from the entry rollers to the exit rollers. The upper and lower manifolds are secured to the idle end of the washer cassette and have outwardly extending inlets that fluidly connect to the filter unit that is integral with the tank by conventional hoses. To provide easy maintenance of the manifolds, it is preferred that the manifold be secured to the idle end of the washer cassette by bolts or other removable fasteners such that the manifolds can be slid out of the cassette quickly and easily.

In accordance with another aspect of the invention, the washer cassette further includes an optional integral exit spray system. The exit spray system is used to provide precise and controlled film coatings on the clean metal blank after it exits from the exit rollers. The exit spray system includes a plurality of nozzles positioned on a support member and connected to the cassette frame member, adjacent to the exit rollers so as to be between the exit rollers and the exit opening. Each nozzle is provided with separate fluid and/or air supply lines such that each nozzle may be independently controlled, either manually or automatically, to deposit film coating on predetermined zones, independently on the top and bottom of the metal blank, thereby conserving film coating.

The washer cassette further desirably includes two air and fluid connection plate assemblies mounted on the entry and exit sides of the washer cassette that have a plurality of air and fluid line connectors and at least one electronic connector plate. The air and fluid connection plates allow for quick one-step connect and disconnect of all air and fluid lines. Similarly, the electronic connector plate provides for a similar quick one-step connect and disconnect of all electronics required to operate the washer system.

Each air and fluid connection plate assembly preferably includes a mounted connection plate and a mating removable connection plate. The mounted connection plate has a plurality of outwardly extending mounting pegs and a plurality of air and fluid line connectors that are operatively connected to the washer components. The removable connection plate has a plurality receiving apertures and a plurality of air and fluid line connectors that are operatively connected to air and fluid lines. The air and fluid line connectors of the mounted connection plate selectively mate to the connectors of the removable plate. Further, the receiving apertures of the removable plate receive the mounting pegs of the mounted connection plate to secure the connection plate assembly together. Preferably, the removable connection plate is pivotally mounted by a support arm to the tank assembly and includes lever arms to selectively lock and unlock the removable connection plate from the mounted connection plate. To disassemble the connection plate, the lever arms are rotated from a locked position to an unlocked position and the removable connection plate, still with all the air and fluid lines connected thereto, is pulled away from the mounted connection plate. The support arm carries the removable connection plate and is pivoted away from the washer cartridge. Thus, the air and fluid lines may be quickly and easily removed from the washer cassette in one motion. It may just as easily be secured during assembly.

The electronic connector plate is preferably a Harding plate that receives a plug-in fitting within an electronic receiver mounted in the electronic plate to allow for one step assembly/disassembly of the electronic components.

In accordance with another aspect of the invention, the interior of the washer cassette is provided with internal flashing mounted to the interior of the washer cassette on the idle and drive ends, around the distal ends of the rollers. The flashing serves to retain the cleaning fluid within the cassette and to protect the bearings of the rollers from damage.

An optional mist collector system may further be provided for the washer system. The mist collector system is preferably a conventional mist collector that is advantageously integrated within the interior of the washer cassette. The mist collector includes ductwork built into the interior of the washer cassette to remove volatile compounds from the interior of the washer cassette, thereby providing a safer working environment.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF THE DRAWINGS

Figure 1:
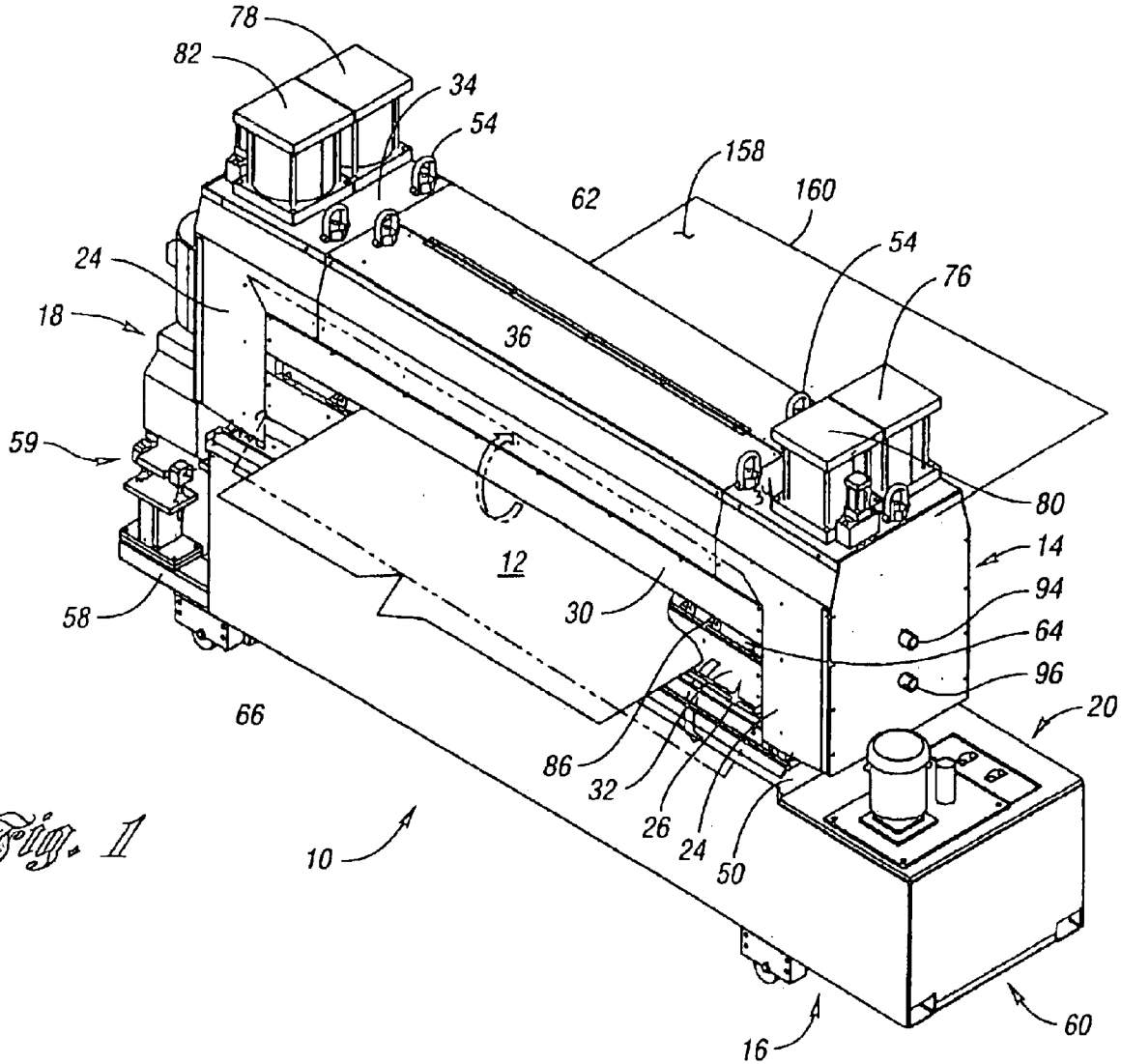
FIG. 1 is a perspective view of a sheet metal washer system in accordance with the present invention.
Figure 4:
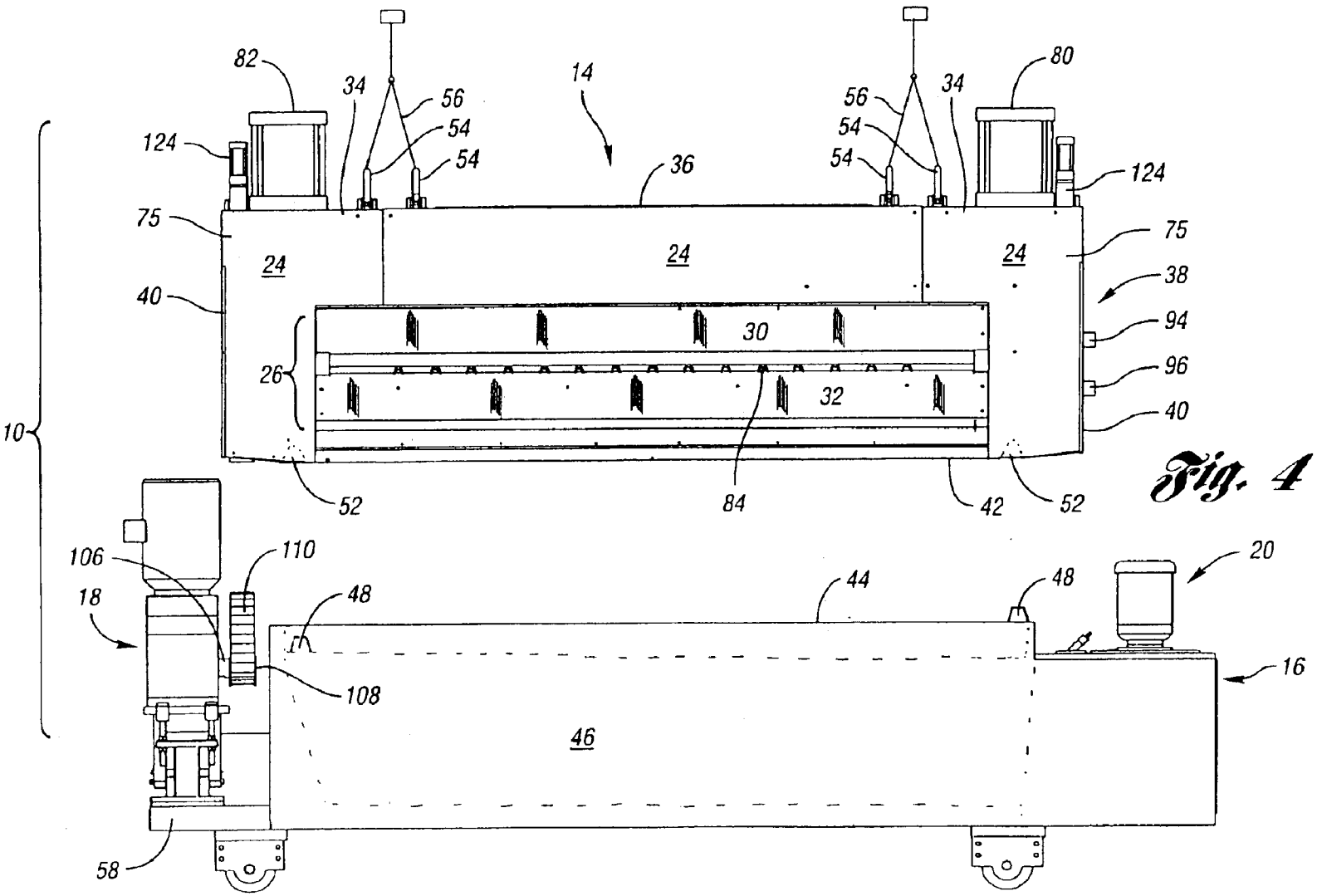
FIG. 4 is a front elevational view of the sheet metal washer system with a washer cassette removed from a tank.
Figure 5:
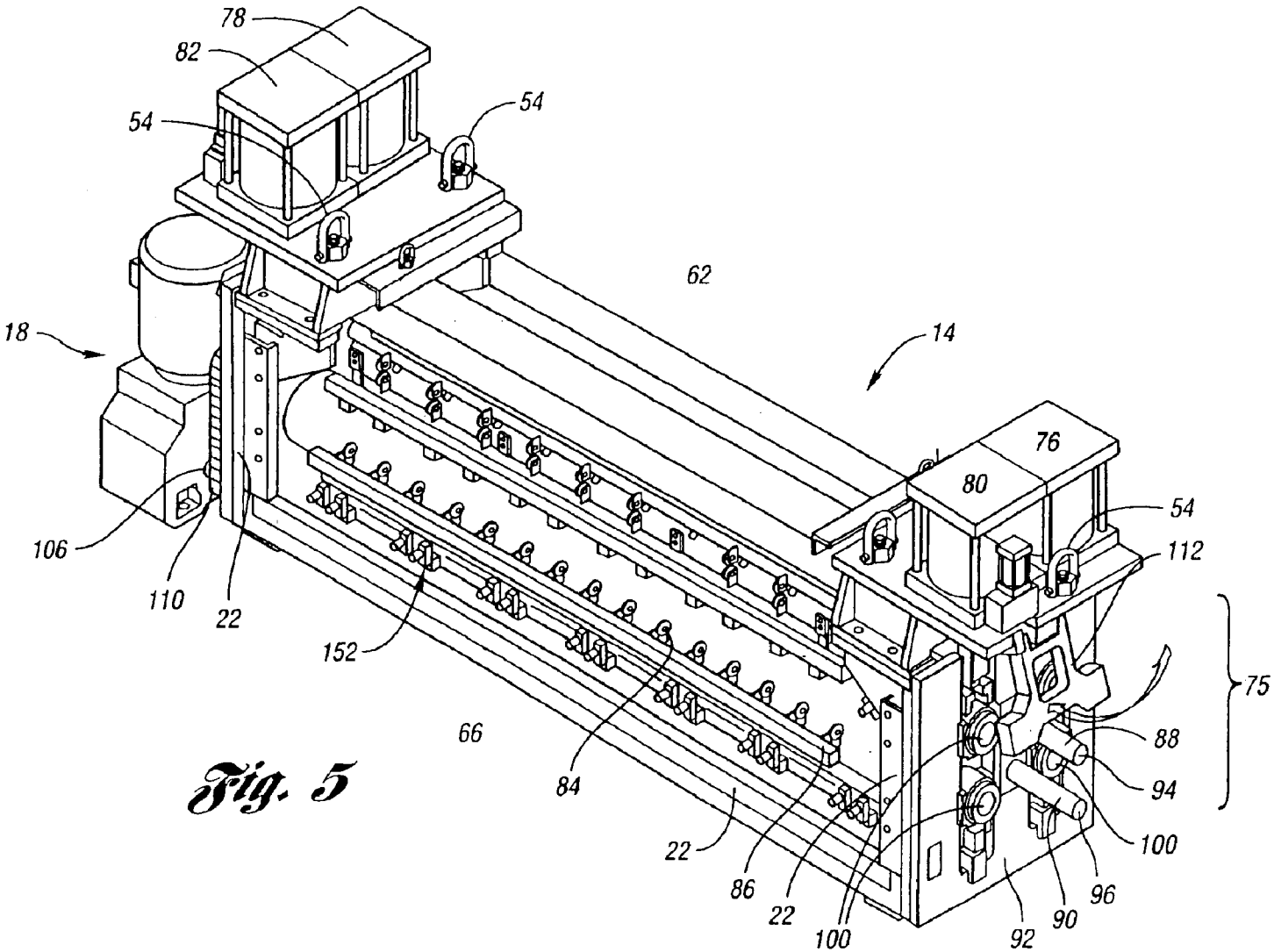
FIG. 5 is a perspective view of an exit side of the washer cassette.

Referring to the Figures, a sheet metal blank washer system 10 for cleaning metal blanks 12 is disclosed. Washer system 10 includes a washer cassette 14 that is selectively removably mounted on a tank assembly 16, a drive motor assembly 18 and a filter system 20. Washer cassette 14 includes a frame member 22, as best seen in FIG. 5, that is covered with a metallic skin 24, preferably constructed of stainless steel for durability. Skin 24 includes hinged access doors 26 on either side of washer cassette 14. Preferably each side of washer cassette 14 includes an upper hinge door 30 and a lower hinge door 32. As best seen in FIG. 1, upper hinge door 30 swings upwardly and preferably includes a retaining mechanism (not shown) for selectively securing upper hinge door 30 skin 24. Lower hinge door 32 swings downwardly and preferably includes a retaining mechanism (not shown) for selectively securing lower hinge door 32 to skin 24. Upper and lower hinge doors 30 and 32 advantageously provide access to the interior of the washer cassette for routine maintenance or in response to failure problems. Similarly, a top surface 34 of washer cassette 14 is provided with a hinged access door 36 that may be selectively lifted upward to permit easy access to the interior of washer cassette 14. End portions 38 of washer cassette 14 are preferably provided with see-through end plates 40, shown best in FIG. 4. Plates 40 are removably connected thereto and permit easy monitoring of operation of washer cassette components as explained in further detail below. The bottom 42 of washer cassette 14, as shown in FIG. 4, is open.

Tank assembly 16 includes an open top 44 that is sized to correspond to open bottom 42 of washer cassette 14. When washer cassette 14 is positioned on tank assembly 16, debris and contaminated fluid from washer cassette 14 is collected in a tank collector 46, to be explained in further detail below. As best seen in FIG. 4, tank assembly 16 preferably includes at least one upwardly projecting locating pin 48 integrally formed in the frame 50 of tank assembly 16. Locating pin 48 is received within a locating aperture 52 formed in the bottom 42 of frame member 22 of washer cassette 14 to insure proper and accurate positioning of washer cassette 14 on tank assembly 16. The two components may be selectively and removably bolted to one another. In accordance with one aspect of the invention, washer cassette 14 is selectively removable from tank assembly 16 such that washer cassette may be removed and substituted with an identical washer cassette 14 to allow for off-line periodic maintenance or repair, without excessive downtime of washer system 10. Accordingly, top surface 34 of washer cassette 14 is provided with heavy duty eyebolts 54 that cooperate with lifting chains 56 to permit selective lift-off of washer cassette 14 from tank assembly 16, as seen in FIG. 4.

Tank assembly 16 further includes an integral platform 58 for supporting drive motor assembly 18. Drive motor assembly 18 is positioned on a drive end 59 of washer system 10. Filter assembly 20 for filtering contaminated fluid from tank collector 46 and re-circulating the fluid into a cleaning spray system within washer cassette 14, is integrated with tank assembly 16, on an end portion of tank assembly 16 opposite of drive assembly 18, to be explained in further detail below. Accordingly, filter assembly 20 is positioned on an idle end 60 of washer system 10.

Figure 3:
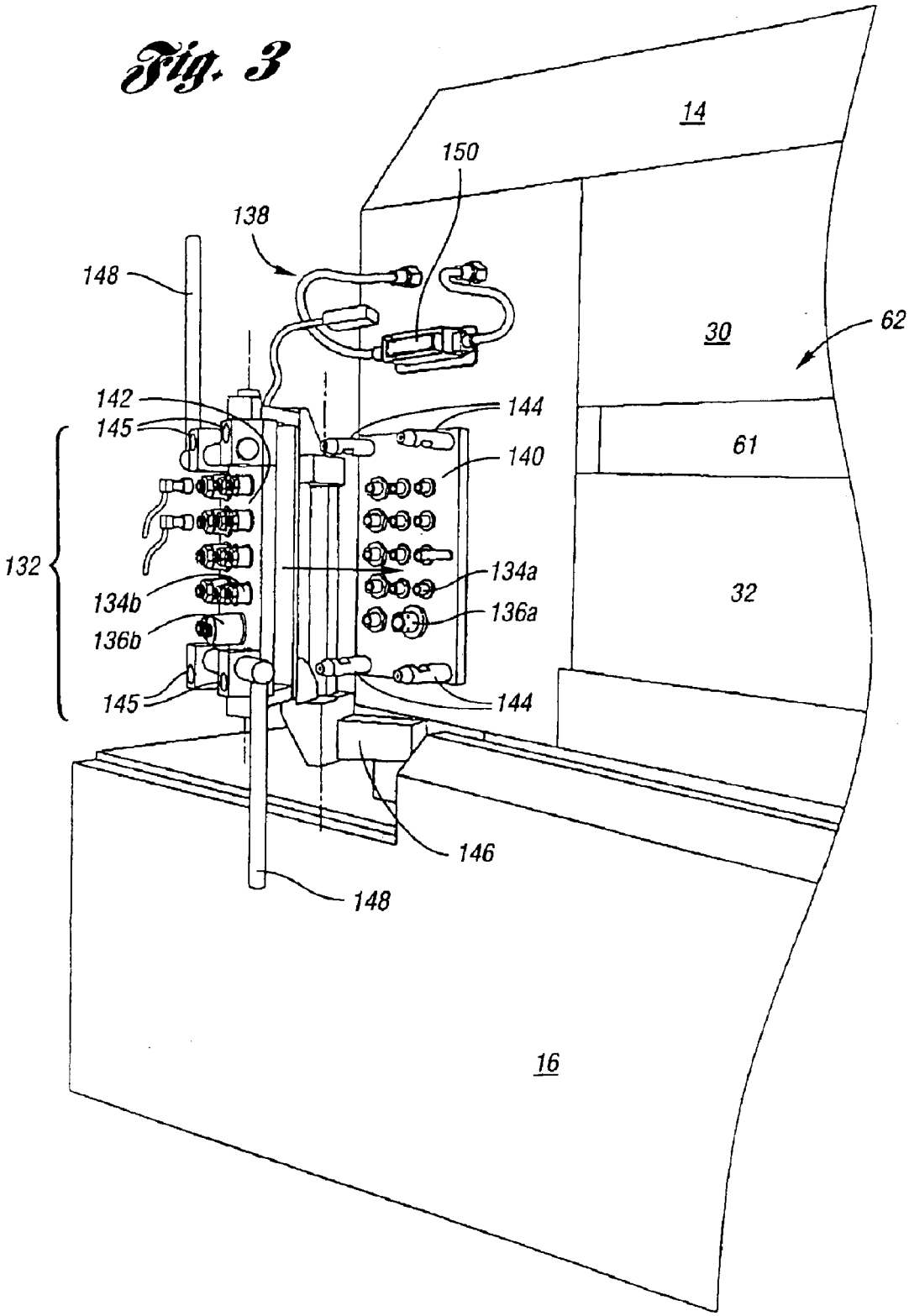
FIG. 3 is a perspective view of a connection plate assembly in accordance with the present invention.

Washer cassette 14 has an inlet opening 61, shown in FIG. 3, formed on an inlet side 62 and an exit opening 64 formed on an exit side 66, shown in FIG. 1. Upper and lower hinged doors 30 and 32 define the inlet opening 61 and exit opening 64. The inlet opening 61 receives metal blank 12 to be cleaned into washer cassette 14 and, after being cleaned, metal blank 12 exits washer cassette 14 through exit opening 64.

Figure 2:
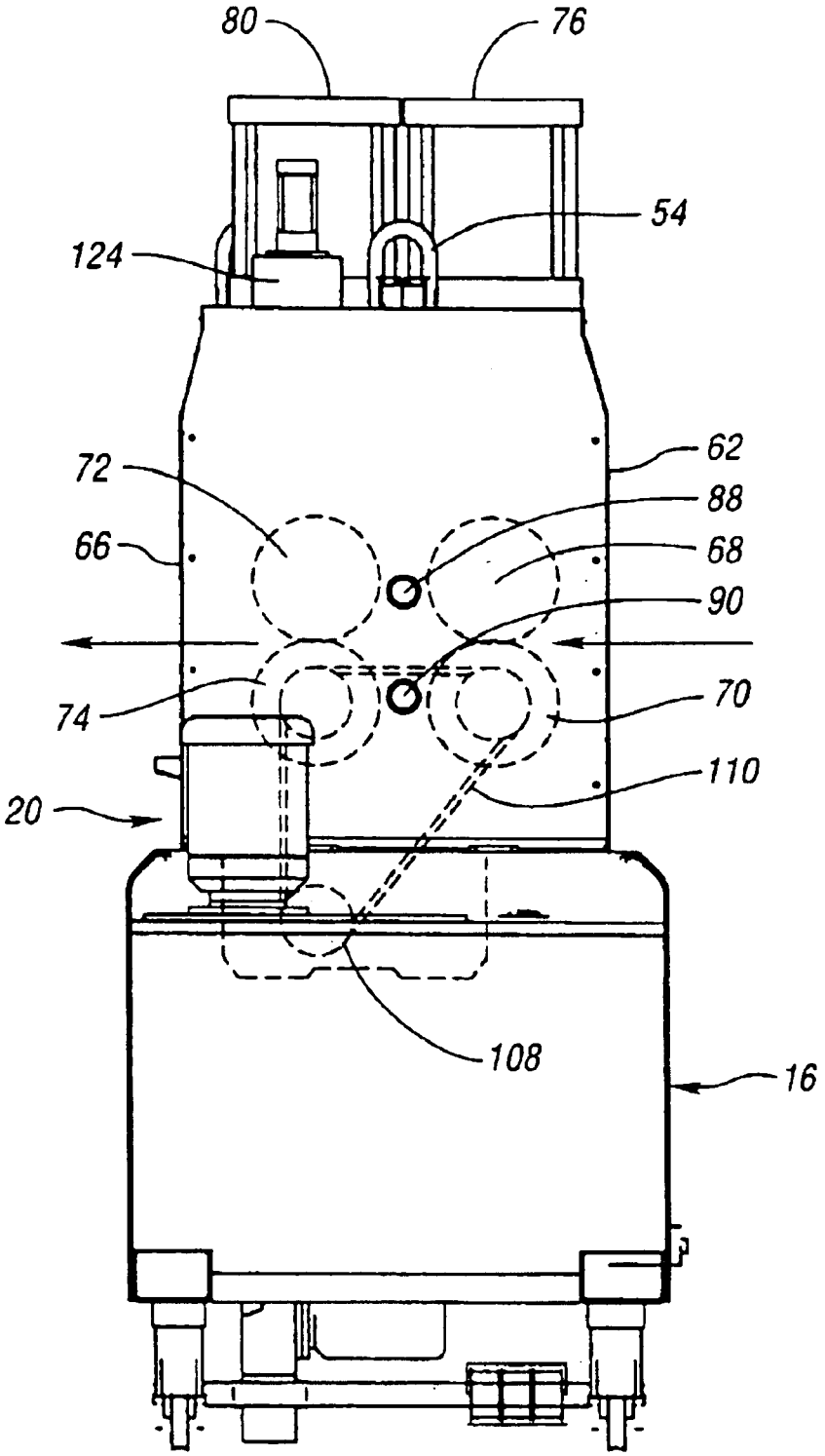
FIG. 2 is a side view of an idle end of the sheet metal washer system.

As best seen in FIG. 2, positioned within washer cassette 14 adjacent to the inlet opening are at least two entry rollers, an upper entry roller 68 positioned directly on top of a lower entry roller 70. Similarly, positioned within washer cassette 14 adjacent to exit opening 64 are at least two exit rollers, an upper exit roller 72 positioned directly on top of a lower exit roller 74. Entry and exit rollers 68, 70, 72 and 74 are connected to bearing housings 75 positioned on either end of washer cassette 14, to be explained in further detail below. When in an operating position, upper entry and exit rollers 68 and 72 are contacting lower entry and exit rollers 70 and 74, respectively, to be explained below in further detail. Entry rollers 68 and 70 are preferably fiber coated and have a first predetermined durometer (preferably less than 80 durometer) such that entry rollers 68 and 70 have a spongy consistency. Exit rollers 72 and 74 are preferably fiber coated and have a second predetermined durometer that is greater than the first predetermined durometer of entry rollers 68 and 70.

As seen in FIG. 1, in operation of washer system 10 metal blank 12 is enters the inlet opening and is directed between entry rollers 68 and 70. Due to the spongy consistency of entry rollers 68 and 70, dirt, debris and mill oil on metal blank 12 are agitated and removed as metal blank 12 passes therethrough. Further, entry rollers 68 and 70 are operatively connected to first air cylinders 76 and 78 to provide a first predetermined pressure in pounds per linear inch (PLI), of approximately 100 PLI, upon metal blank 12 as it is passed therebetween. Next, metal blank 12 is directed through exit rollers 72 and 74. Due to the durometer of exit rollers 72 and 74, water and cleaning fluid that is injected into washer cassette 14, to be explained below, is removed from metal blank 12 by a squeegee action as it is passed through exit rollers 72 and 74 to dry metal blank 12. Exit rollers 72 and 74 are connected to second air cylinders 80 and 82 to exert a second predetermined pressure of approximately 100–175 PLI on to metal blank 12 as it passes therethrough. By providing air cylinders 76, 78, 80 and 82 for both entry and exit rollers 68, 70 and 72, 74, respectively, the pressure exerted by the rollers 68, 70 and 72, 74 is increased over prior art designs which only utilized an air cylinder on the exit rollers. Thus, washer system 10 can effectively operate with both water and oil based cleaning agents, as opposed to prior art designs that do not have pressure capabilities over 100 PLI, such that oil based cleaning agents could not be employed.

To insure that metal blank 12 is properly directed between entry and exit rollers 68, 70 and 72, 74, respectively, positioned adjacent to the inlet opening and exit opening 64 are a plurality of small guide rollers 84. In one preferred embodiment, guide rollers 84 are positioned on support bars (not shown) that are mounted on the lower hinged doors 32 with guide rollers 84 engaging metal blank 12 upon entering the inlet opening and engaging metal blank 12 upon exiting exit rollers 70 and 72. Alternatively, as seen in FIG. 5, a support bar 86 having guide rollers 84 mounted thereon may be fixedly secured to frame member 22 of washer cassette 14.

In accordance with another aspect of the invention, washer cassette 14 further includes an integral cleaning spray system. The cleaning spray system includes top and bottom manifolds 88 and 90, respectively that extend the length of washer cassette 14 and include a plurality of fluid nozzles 91 extending therefrom. Top and bottom manifolds 88 and 90 are secured to an idle end 92 of the washer cassette 14 and have outwardly extending inlets 94 and 96 that fluidly connect to filter assembly 20 by conventional equipment such as fluid hoses. Filter system 20 directs the cleaning fluid used to clean metal blank 12 and delivers the cleaning fluid to manifolds 88 and 90. As mentioned above, washer system 10 is able to use both water and oil based cleaning agents. To provide easy maintenance of the top and bottom manifolds 88 and 90, it is preferred that top and bottom manifolds 88 and 90 are removably secured to idle end 92 of washer cassette 14 by bolts or other removable fasteners. Accordingly, top and bottom manifolds 88 and 90 may be slid out of washer cassette 14 quickly and easily.

Figure 7:
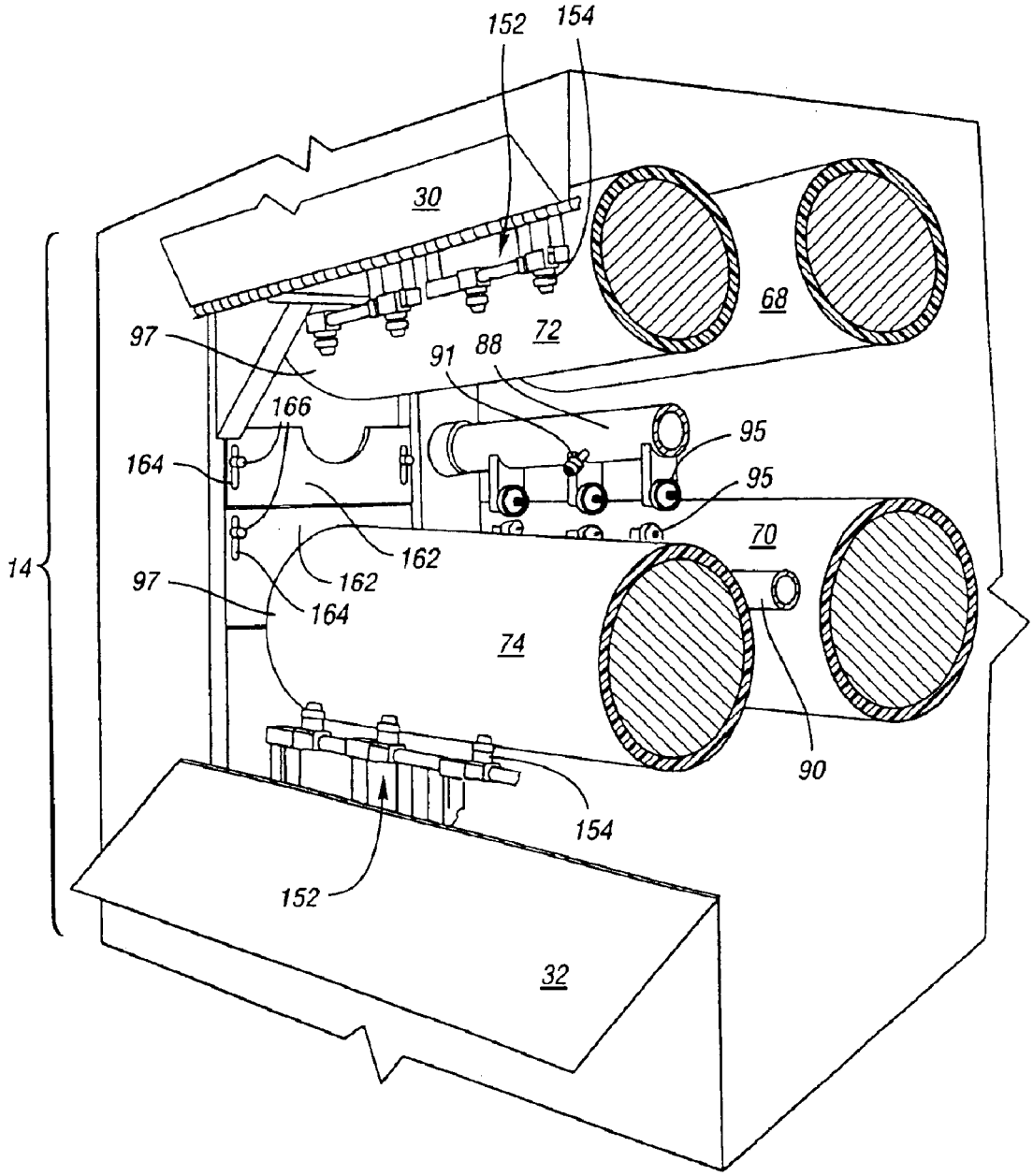
FIG. 7 is a perspective view of the interior of the washer cassette from the exit side of the washer cassette.

As best seen in FIGS. 2 and 7, top manifold 88 is positioned within washer cassette 14, between upper entry and exit rollers 68 and 72 with nozzles 91 extending downwardly at a predetermined angle to spray cleaning fluid at the nip (roller contact portion on metal blank 12) of both upper entry and exit rollers 68 and 72. Preferably, nozzles 91 are equally spaced apart so as to provide a uniform distribution of cleaning fluid on to metal blank 12. Similarly, bottom manifold 90 is positioned between lower entry and exit rollers 70 and 74, spaced away from and directly beneath top manifold 88, with nozzles 91 extending upwardly at an angle to spray cleaning fluid at the nip of both lower entry and exit rollers 70 and 74. To insure metal blank 12 is properly guided from entry rollers 68 and 70 to exit rollers 72 and 74, it is preferred that top manifold 88 includes a plurality of downwardly extending small guide rollers 95 and bottom manifold 90 includes a plurality of upwardly extending small guide rollers 9. Guide rollers 95 of top and bottom manifolds 88 and 90 are spaced apart from one another to provide a clearance that receives metal blank 12.

In accordance with one aspect of the invention, entry and exit rollers 68, 70, 72 and 74 are connected to bearing housings 75 on each end of washer cassette 14. Distal ends 97 of entry and exit rollers 68, 70, 72 and 74 are connected to bearing housing 75 at drive end 98 of the washer cassette 14 by means of non-expandable bearings so that the performance of timing belt 110 remains impaired. Distal ends 100 of entry and exit rollers 68, 70, 72 and 74 are connected to bearing housing 75 at idle end 92 of the washer cassette 14 by means of expandable bearings that compensate for a small degree of expansion of the rollers due to the heat generated by the washer system 14 components during operation.

Figure 6:
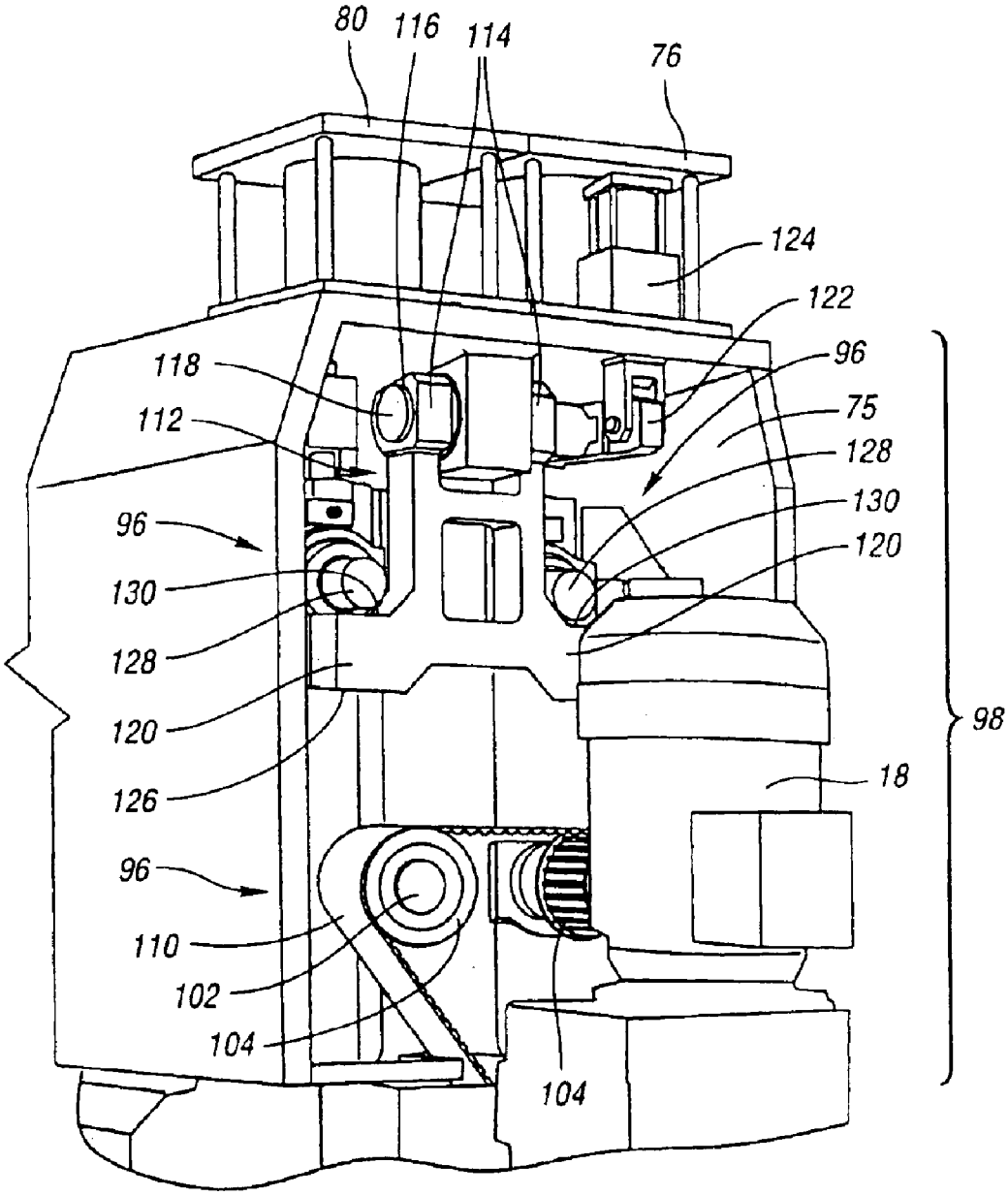
FIG. 6 is a perspective view of a safety lock mechanism and motor drive for the sheet metal washer system.

Lower entry and exit rollers 68 and 72 are each provided with an extended shaft 102 on distal end 96 of rollers 68 and 72, shown best in FIG. 6, and have a key member (not shown) for connecting to a shaft drive bearing 104. Drive motor assembly 18 is positioned on drive end 98 of washer cassette 14, below washer cassette 14 on platform 58 of tank assembly 16. Drive motor assembly 18 includes an outwardly extending input shaft 106 that is connected to a motor drive bearing 108 as best shown in FIG. 4. A selectively removable timing belt 110 is connected to the motor drive bearing 108 and shaft drive bearings 104 to drive the lower entry and exit rollers 68 and 72. Upper entry and exit rollers 70 and 74, when in an operating position, are positioned in contact with one another such that the upper entry and exit rollers 70 and 74 are friction driven by the lower entry and exit rollers 68 and 72. Thus, washer system 10 has a simplified drive mechanism over prior art designs. An extremely tight fit for metal blank passage is also provided, thereby helping to maximize blank cleanliness. It is the spongy or selectively deformable nature of the rollers that permits the metal blank to pass between them since the outer surfaces of each roller is in contact with its mating roller. Once a blank passes, each roller returns to its non-deformed shape. Further, in accordance with another aspect of the invention, disassembly of the drive mechanism is quickly and easily achieved by simply removing timing belt 110. It is preferred that bearing housing 75 at drive end 98 of the washer cassette 14 is recessed, as best seen in FIG. 6, in which shaft drive bearings 104 are located. Input shaft 106, with driveshaft bearing 108 positioned thereon, extends into the recessed bearing housing 75. A selectively removable see-through end plate 40 is provided with an aperture for receiving input shaft 106 and end plate 40 is positioned over the recessed bearing housing 75 to protect the drive assembly 20 components from damage while allowing visibility of the drive assembly 20 to monitor its operation.

In accordance with another aspect of the invention and as best shown in FIG. 6, there is provided a safety lock mechanism 112 on both idle and drive ends 92 and 98 of washer cassette 14. Safety lock mechanism 112 is a pivoting spring loaded, pneumatically controlled member that moves between an unlocked operating position and a locked position. Safety lock mechanism 112 has an inverted T-shape and includes a pivoting end 114 that is provided with apertures 116 for receiving a pivoting shaft 118. Outwardly extending support arms 120 are positioned opposite pivoting end 114. Pivoting shaft 118 is connected to an input arm 122 that is operatively connected to an air cylinder 124. When washer system 10 is in an operating mode and upper entry and exit rollers 68 and 72 are contacting lower entry and exit rollers 70 and 74, support arms 120 are positioned above upper entry and exit rollers 68 and 72. A bottom surface 126 of support arms 120 is adjacent stub ends 128 of upper entry and exit rollers 68 and 72 to maintain upper entry and exit rollers 68 and 72 in the operating position. When washer system 10 is shut off, safety lock mechanism 112 is automatically pivoted outwardly and upper entry and exit rollers 68 and 72 are raised by air cylinders 76 and 80 away from the lower entry and exit rollers 70 and 74. Next, safety lock mechanism 112 is pivoted inwardly between the upper entry and exit rollers 68 and 72 and lower entry and exit rollers 70 and 74 and locked into position. While in the locked position, a top surface 130 of support arms 120 support stub ends 128 of the upper entry and exit rollers 68 and 72. When engaged, safety lock mechanism 112 advantageously provides clearance between the upper entry and exit rollers 68 and 72 and lower entry and exit rollers 70 and 74 to permit safe and easy access therebetween, providing for routine maintenance of the interior of washer cassette 14. Safety lock mechanism 112 may also be utilized when transporting a washer cassette 14 to insure that entry and exit rollers 68, 70, 72 and 74 do not rub against one another during transport causing surface cuts or scratches, thereby prolonging wear life of entry and exit rollers 68, 70, 72 and 74.

Washer cassette 14 preferably includes at least one air and fluid connection plate assembly 132 to permit quick and easy assembly and disassembly of all air and fluid hoses (not shown). As best seen in FIG. 3, connection plate assembly 132 is mounted on either inlet or exit sides 62 and 68 of washer cassette 14 and has a plurality of air and fluid line connectors 134 and 136. At least one electronic connector plate 138 is also provided. Connection plate assembly 132 allows for one-step connection/disconnection of all air and fluid lines that are required to operate washer system 10. Similarly, electronic connector plate 138 provides for one-step connection/disconnection of all electronics required to operate washer system 10.

Each air and fluid connection plate assembly 132 includes a connection plate 140 mounted on the cassette washer and a removable connection plate 142. Mounted connection plate 140 has a plurality of outwardly extending mounting pegs 144 and a plurality of air and fluid line connectors 134*a* and 136*a* that are operatively connected to washer cassette 14 components. Removable connection plate 142 has a plurality receiving apertures 145 and a plurality of air and fluid line connectors 134*b* and 136*b* that are operatively connected to air and fluid lines. Air and fluid line connectors 134*a* and 136*a* of mounted connection plate 140 correspond to air and fluid line connectors 134*b* and 136*b* of removable connection plate 142. Further, the receiving apertures of the removable plate 142 receive mounting pegs 144 of the mounted connection plate 140 to secure connection plate assembly 132 together. Preferably, removable connection plate 142 is pivotally mounted to tank assembly 16 by a support arm 146 and includes lever arms 148 to selectively lock and unlock removable connection plate 142 form the mounted connection plate 140. To disassemble connection plate assembly 132, lever arms 148 are rotated from a locked position to an unlocked position, disengaging mounting pegs 144 from the receiving apertures and removable connection plate 142, still with all the air and fluid lines connected thereto, is pulled away from the mounted connection plate 140. Support arm 146 carries removable connection plate 142 and pivots away from washer cartridge 14. Thus, the air and fluid lines may be quickly and easily removed form washer cassette 14 in one motion.

Electronic connector plate 138 is preferably a Harding plate that receives a plug-in fitting within an electronic receiver 150 formed in electronic plate 138 to allow for one step assembly/disassembly of all electronic components needed to properly operate washer system 10.

In accordance with another aspect of the invention, washer cassette 14 preferably further includes an optional integral exit spray system 152, as best seen in FIGS. 5 and 7. Exit spray system 152 is used to provide precise and controlled film coatings on metal blank 12 after its been cleaned and dried by entry and exit rollers 68, 70, 72 and 74 after metal blank 12 exits from exit rollers 70 and 74. Exit spray system 152 includes a plurality of nozzles 154 positioned on a support member 156 and connected to washer cassette 14 frame member 22, adjacent to exit rollers 70 and 74 so as to be between the exit rollers 70 and 74 and exit opening 64. Each nozzle 154 is provided with separate fluid and/or air supply lines such that each nozzle 154 may be independently controlled, either manually or automatically, to deposit a predetermined film coating on discrete zones of metal blank 12 and on either top and bottom surfaces 158 and 160 of metal blank 12, thereby conserving film coating.

The interior of washer cassette 14 adjacent bearing housings 75, is desirably provided with adjustable flashing sections 162. Flashing sections 162 are positioned around distal ends 97 of entry and exit rollers 68, 70, 72 and 74 and are provided with slots 164 that receiving pins 166 to provide for adjustability flashing sections 162. Flashing sections 162 serve to retain the cleaning fluid and film coating within washer cassette 14 and to protect bearings of entry and exit rollers 68, 70, 72, 74 from damage caused by corrosive effects of the cleaning fluid and the film coating.

An optional mist collector system (not shown) may also be integrated within washer cassette 14. Mist collector is a conventional system that includes duct work built into the interior of washer cassette 14 to remove volatile compounds from the interior of washer cassette 14, thereby providing a safer working environment.

To quickly and easily disassemble washer system 10 to allow for routine maintenance of washer cassette 14 components, such as redressing of rollers 68, 70, 72 and 74, washer system 10 is turned off, automatically raising upper entry and exit rollers 68 and 72 and actuating safety lock mechanism 112. Timing belt 110 is removed from shaft drive bearings 104 and motor drive bearing 108, thereby disengaging drive motor assembly 18 from washer cassette 14. Hoses that are used to fluidly connect filter assembly 20 to top and bottom manifolds 88 and 90 are removed from manifold inlets 94 and 96 by way of a quick connect/disconnect mechanism. Lever arms 148 are actuated to selectively unlock removable connection plate 142, still with all air and fluid hoses connected thereto, from mounted connection plate 140. Removable connection plate 142 is then pivoted away from mounted connection plate 140, thereby disconnecting all air and fluid connections from washer cassette 14. The electronic plug-in fitting is disengaged from electronic connector plate 138, thereby quickly disconnecting all electronic wires from washer cassette 14. Finally, chains 56 are engaged with eyebolts 54 mounted on washer cassette 14 and washer cassette 14 is lifted from tank assembly 16 by a crane or other suitable mechanism once any bolts or other removable fasteners connecting the components are loosened.

Although certain preferred embodiments of the present invention have been described, the invention is not limited to the illustrations described and shown herein, which are deemed to be merely illustrative of the best modes of carrying out the invention. A person of ordinary skill in the art will realize that certain modifications and variations will come within the teachings of this invention and that such variations and modifications are within its spirit and the scope as defined by the claims.

What is claimed is:

1. A sheet metal blank washer comprising:

a tank assembly;

a washer cassette adapted to be removably mounted on said tank assembly; one of said tank assembly and said washer cassette including at least locating member that engages a mating locating member of the other of said tank assembly and said washer cassette to insure proper positioning of said washer cassette with respect to said tank assembly;

said washer cassette including a pair of opposing entry rollers and a pair of opposing exit rollers, a blank adapted to pass through said opposing rollers;

at least one selectively removable air and fluid connection plate assembly including a connection plate mounted on the washer cassette and a removable connection plate, said mounted connection plate having a plurality of air and fluid connections and mounting pegs thereon, said removable connection plate having a plurality of air and fluid connections that correspond to said air and fluid connections of said mounted connection plate and that receive air and fluid lines to operate said washer assembly, and mounting apertures for receiving said mounting pegs to secure said removable connection plate to said mounted connection plate.

2. The sheet metal blank washer recited in claim 1, wherein said entry rollers have a first predetermined durometer and said exit rollers have a second predetermined durometer.

3. The sheet metal blank washer as recited in claim 2, wherein said first predetermined durometer is less than said second predetermined durometer.

4. The sheet metal blank washer as recited in claim 1, wherein each of said rollers is configured to compress against an outer surface of the blank as it passes between opposing rollers.

5. The sheet metal washer as recited in claim 1, further including at least one electrical connection assembly having a mounted electrical connection member that is secured to said washer cartridge, and a removable electrical plug member receivable within said electrical connection member.

* * * * *